United States Patent [19]

Gibson

[11] Patent Number: 4,541,391

[45] Date of Patent: Sep. 17, 1985

[54] TIMING CONTROL FOR FUEL INJECTION APPARATUS

[75] Inventor: Dennis H. Gibson, Edelstein, Ill.

[73] Assignee: Caterpillar Tractor Co., Peoria, Ill.

[21] Appl. No.: 593,915

[22] Filed: Mar. 27, 1984

[51] Int. Cl.[4] ..... F02M 41/06

[52] U.S. Cl. ..... 123/500; 123/364; 417/270; 464/5

[58] Field of Search ..... 123/500, 450, 503, 502, 123/374, 364, 449, 372, 501; 417/270; 464/2, 5

[56] References Cited

U.S. PATENT DOCUMENTS

| | | | |
|---|---|---|---|
| 2,667,840 | 2/1954 | High | 123/450 |
| 2,743,594 | 5/1956 | Hill et al. | 82/27 |
| 2,790,432 | 4/1957 | Shallenberg et al. | 123/450 |
| 4,108,130 | 8/1978 | Bailey | 123/502 |
| 4,200,072 | 4/1980 | Bailey | 123/450 |
| 4,312,312 | 1/1982 | Hofer et al. | 123/502 |

FOREIGN PATENT DOCUMENTS 2441611 3/1975 Fed. Rep. of Germany .

*Primary Examiner*—Craig R. Feinberg
*Assistant Examiner*—David A. Okonsky
*Attorney, Agent, or Firm*—John W. Grant

[57] ABSTRACT

Fuel injection apparatuses are used to inject fuel into the combustion chambers of compression ignition engines. The known mechanical drive arrangements for driving the distributor rotor and controlling beginning moment of fuel injection are complex, bulky and expensive to manufacture. The subject timing control for fuel injection apparatus includes a planetary gear arrangement driven by a pumping section and drivingly connected to a distributor rotor. A ring gear controls the timing phase relationship between the rotor and a delivery passage communicating the pumping section with the rotor. A riser of a flyweight assembly is mechanically connected to the ring gear so that the ring gear is positioned in accordance with the engine speed. The planetary gear arrangement is of simple construction requiring a minimum of space and is relatively inexpensive to manufacture.

6 Claims, 7 Drawing Figures

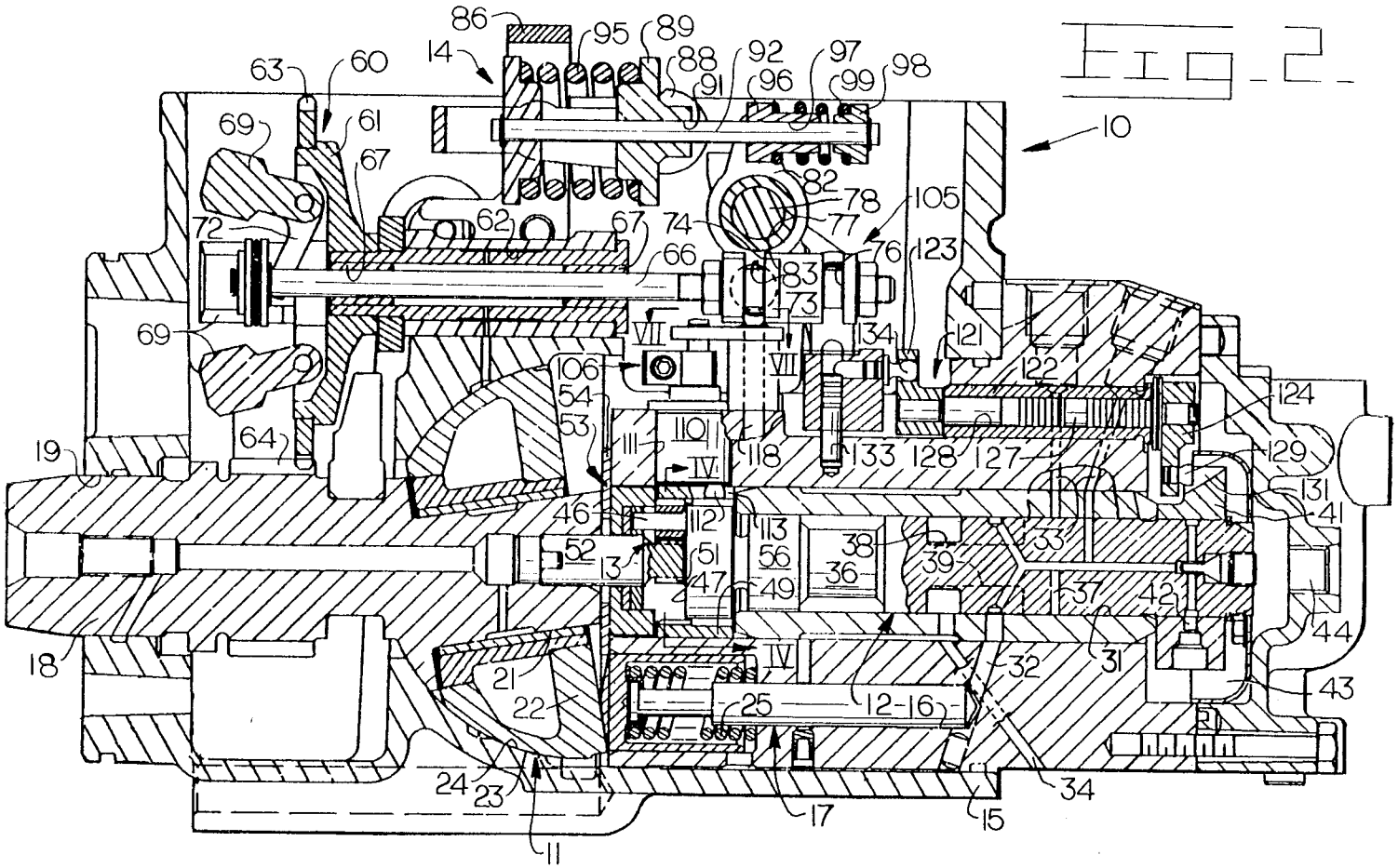

TIMING CONTROL FOR FUEL INJECTION APPARATUS

DESCRIPTION

1. Technical Field

This invention relates generally to a fuel injection apparatus and more particularly to a timing control for controlling beginning moment of fuel injection of such fuel injection apparatus.

2. Background Art

Some fuel injection systems for compression ignition engines use a distributor type fuel injection apparatus for selectively injecting fuel into the combustion chambers. Such systems commonly have a rotary distributor rotor for synchronizing delivery of fuel from the pump unit to the fuel injectors. It is well known that as engine speed increases better efficiency is obtained if the fuel injection timing is advanced. U.S. Pat. No. 4,200,072 which issued to J. M. Bailey on Apr. 20, 1980 shows one such system in which the fuel injection timing is advanced by varying the timing phase relationship of the distributor rotor relative to the rotating assembly through a gear arrangement. One of the problems associated with that system is that it employs a compound planetary gear arrangement requiring an additional ring gear for controlling the phase relationship of the metering rotor. Such additional ring gear adds significantly to the cost of the timing control mechanism. Moreover, that compound planetary gear arrangement takes up a significant portion of the space of the fuel injection apparatus such that the apparatus is quite bulky. Finally, the postion of the ring gear of that system is controlled by fluid pressure generated by a pump assembly in response to the rotational speed. It is desirable in many instances to control the injection timing by a more positive mechanical speed sensitive device.

The present invention is directed to overcoming one or more of the problems as set forth above.

DISCLOSURE OF THE INVENTION

In one aspect of the present invention a fuel injection apparatus includes a pumping means for delivering charges of fuel at timed intervals, a housing having a plurality of outlet ports, a distributor rotor rotatably mounted in the housing, a delivery passage communicating the charges of fuel to the distributor rotor, and a speed responsive device driven by the pumping means and including an element movable in response to changes in the speed of the pumping means. The apparatus further comprises means for driving the distributor rotor in timed relationship to the pumping means for synchronizing the distribution of fuel charges from the pumping means to the outlet ports. The means includes a planetary gear arrangement driven by the pumping means and drivingly connected to the distributor rotor. A means mechanically connects the ring gear to the element of the speed responsive device so that the ring gear is rotated in response to movement of the element.

The present invention provides a simple planetary gear arrangement for controlling the timing phase relationship between the distributor rotor and the pumping unit and hence between the distributor rotor and the delivery passage from the pumping unit to the distributor rotor. The simple planetary gear arrangement takes up a minimum of space and is inexpensive to manufacture and yet provides the precision control over the timing phase relationship required for the fuel injection timing control of today's high technology compression ignition engines.

BRIEF DESCRIPTION OF THE DRAWINGS

FIG. 2 is a sectional view taken generally along line II—II of FIG. 1;

BEST MODE FOR CARRYING OUT THE INVENTION

Figure 1:
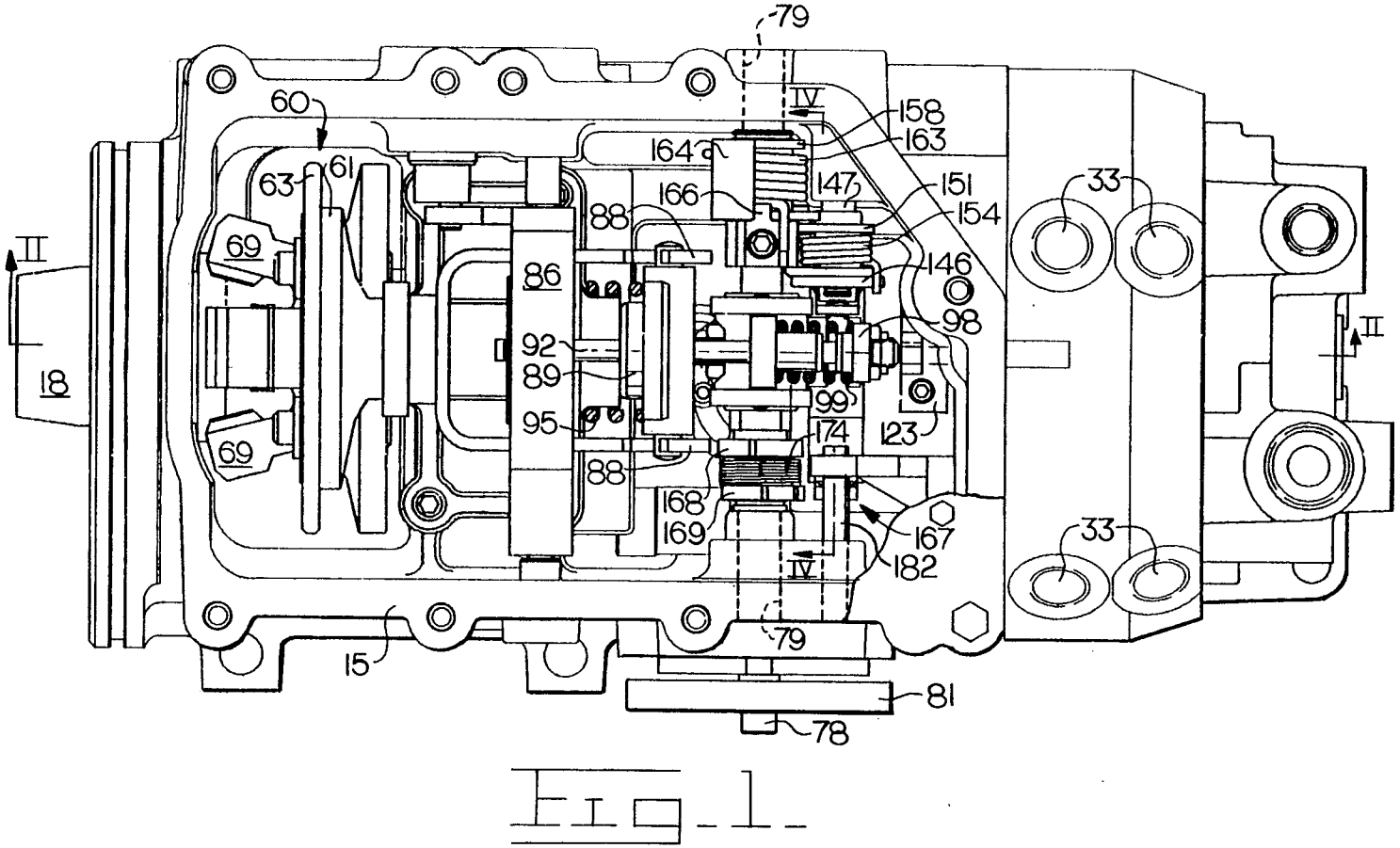
FIG. 1 is a top plan view of an embodiment of the present invention.

Referring now to FIGS. 1 and 2 a fuel injection apparatus is generally indicated by the reference numeral 10 and includes a pumping section 11, a distributing section 12, a planetary gear arrangement 13 driven by the pumping section 11 and drivingly connected to the distributing section 12, and a governor section 14 contained within a common multi-piece housing 15.

The pumping section 11 is of the nutating type and includes a pumping chamber 16 defined in the housing 15, a plunger assembly 17 reciprocatably disposed in the pumping chamber 16, a drive shaft 18 suitably journalled within a bore 19 of the housing 15 and having an angled eccentric portion 21 formed thereon, and a nutating disc 22 journalled on the eccentric portion 21 of the drive shaft 18. The nutating disc 22 has a spherical surface 23 seated in a mating concave spherical bearing surface 24 defined by the housing 15. A spring 25 resiliently urges the plunger assembly 17 into intimate contact with the nutating disc 22.

The distributing section 12 includes a bore 31 defined in the housing 15 and a delivery passage 32 communicating the pumping chamber 16 with the bore 31. A plurality of outlet ports 33 defined in the housing communicate with the bore 31 in a predetermined pattern and are connectable to the combustion chambers (not shown) in the usual manner. An inlet passageway 34 communicates with the bore 31 and is connectable to a fuel transfer pump (not shown). A distributor rotor 36 is rotatably positioned within the bore 31 and has an internal passage 37 selectively communicatable with the delivery passage 32 and the outlet ports 33 in a predetermind timed pattern. An annular groove 38 formed in the distributor rotor 36 is in continuous communication with the inlet passageway 34. A plurality of axial extending slots 39 formed in the distributor rotor selectively communicate the annular groove 38 with the delivery passage 32. A metering collar 41 is rotatably positioned on the distributor rotor and has a vent port 42 defined therein. The vent port 42 selectively communicates the internal passage 37 with a spill chamber 43 which in turn is connectable to the fuel tank (not shown) through an exhaust port 44.

Figure 3:
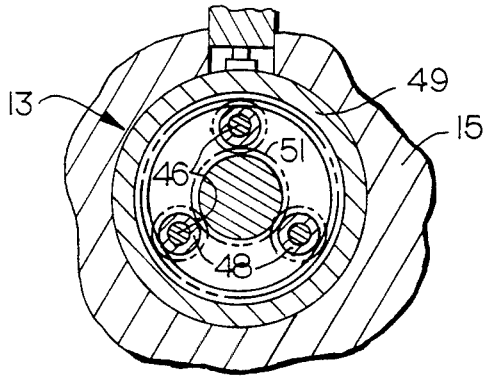
FIG. 3 is a somewhat enlarged sectional view taken along line III—III of FIG. 2.

The planetary gear arrangement 13 as best shown in FIGS. 2 and 3 includes a plurality of carrier pins 46 connected to and extending axially from an end 47 of the distributor rotor 36. Each of the carrier pins 46 rotatably carries a planet gear 48 which meshes with a ring gear 49 and a sun gear 51. The sun gear 51 is integrally connected to a shaft 52 drivingly connected to the drive shaft 18. The end portion of the carrier pins extend into and support an annular thrust bearing assembly 53 which abuts a plate 54 suitably secured to the housing 15. A land 56 on the distributor rotor 36 isolates the planetary gear arrangement 13 from the fuel flow path.

The governing section 14 includes a flyweight assembly 60 responsive to the speed of the drive shaft 18 of the pumping section 11 and hence to the speed of the engine to which the fuel injection apparatus 10 is connected. The flywheel assembly 60 includes a flyweight carrier 61 rotatably positioned within a bore 62 of the housing 15. A gear 63 is connected to the carrier 61 and meshes with a gear 64 formed on the drive shaft 18. A riser shaft 66 extends through a pair of axially spaced bearings 67 connected to the flyweight carrier 61. A thrust bearing 68 is connected to the end of the riser shaft 66. A plurality of flyweights 69 are pivotally mounted to the flyweight carrier 61 with each flyweight having an arm 72 extending generally radially inwardly in thrust producing contact with the thrust bearing 68. A cylindrical riser 73 is connected to the other end of the riser shaft 66 and has a pair of axially spaced annular grooves 74,76 formed therein. A pair of flat surfaces are provided on opposite sides of the riser 73 and form a pair of shoulders one shown at 77. The riser 73 thus moves in a rectilinear direction in response to changes in speed of the flyweight carrier 61 in the usual manner.

Figure 6:
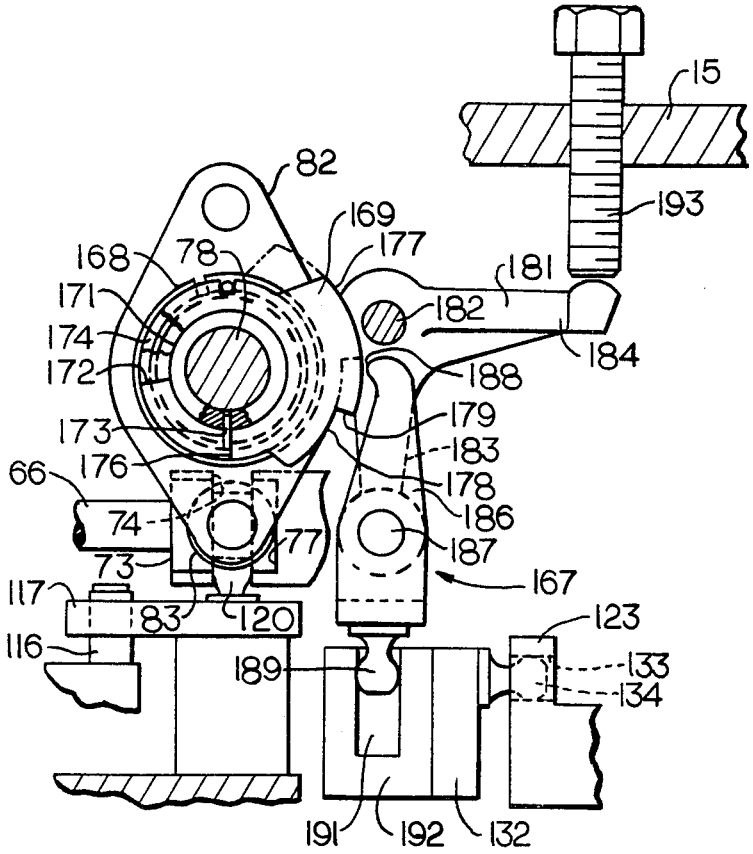
FIG. 6 is a partial sectional view taken along line VI—VI of FIG. 4.

A control shaft 78 is pivotally mounted in a pair of axially aligned bores 79 in the housing 15. A control lever 81 is connected to the end of the control shaft protruding from the housing 15 and is connectable to an accelerator pedal (not shown) in the usual manner. A bifurcated riser lever 82 is pivotally mounted on the control shaft 78 with the lower end portion thereof straddling the cylindrical riser 73. A pair of rollers, one shown at 83 in FIG. 6, are rotatably carried on the lower end portion of the riser lever 82 and engage the shoulders 77 on the riser 73.

A generally U-shaped mounting bracket 86 is connected to the housing 15. A spring seat retainer 87 is pivotally connected to the mounting bracket 86 and has a pair of hooks 88 defined therein. A spring seat 89 is pivotally seated in the hooks and has a bore 91 extending longitudinally therethrough. A shaft 92 slidably extends through the bore 91 and has a spring retainer 93 suitably retained on an end portion thereof. A coiled compression spring 95 is positioned between the spring seat 89 and the spring retainer 93. Another spring seat 96 has a bore 97 extending longitudinally therethrough and slidably receives the shaft 92. The spring seat 96 is positioned between the bifurcated upper end portion of the riser lever 82 and is pivotally connected thereto. Another spring retainer 98 is suitably retained on the other end of the shaft 92. A second coiled compression spring 99 is positioned between the spring seat 96 and the spring retainer 98.

A means 105 is provided for mechanically connecting the ring gear 49 to the riser 73 so that the ring gear is rotated in response to movement of the riser.

Figure 7:
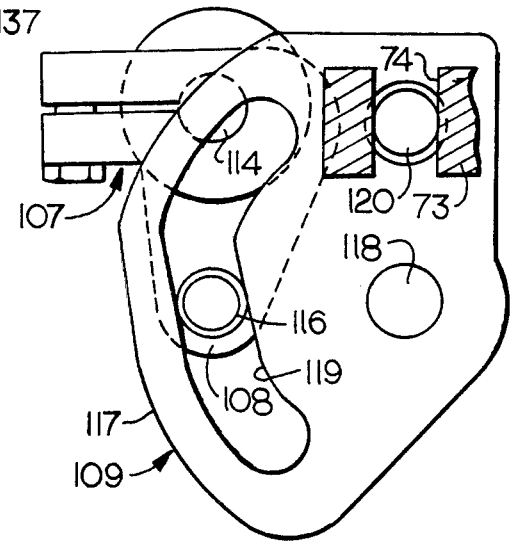
FIG. 7 is a somewhat enlarged view taken along line VII—VII of FIG. 2.

The mechanical connecting means 105 includes a linkage means 106 for translating rectilinear motion of the riser 73 into rotary motion of the ring gear 49. Referring to FIGS. 2 and 7, the linkage means 106 includes a lever mechanism 107 having a lever arm 108 and a means 109 for connecting the lever arm 108 to the riser 73. The lever mechanism 107 includes a cylindrical body 110 pivotally positioned within a bore 111 in the housing 15. A spherical pin 112 extends from the lower end of the body and is eccentrically disposed relative to the longitudinal axis of the body. The pin 112 extends into a slot 113 defined in the ring gear 49. The lever arm 108 is secured to a centrally disposed shaft 114 extending from the upper end of the body and carries a cam follower 116 thereon. The connecting means 109 includes the annular groove 74 in the riser 73, the cam follower 116, and a timing cam 117 pivotally mounted on a shaft 118 connected to the housing. The timing cam 117 has a timing slot 119 defined therein. A pin 120 is connected to the cam 117 and extends into the annular groove 74 in the cylindrical riser 73. The cam follower 116 extends into the timing slot 118 of the timing cam 117.

Figure 4:
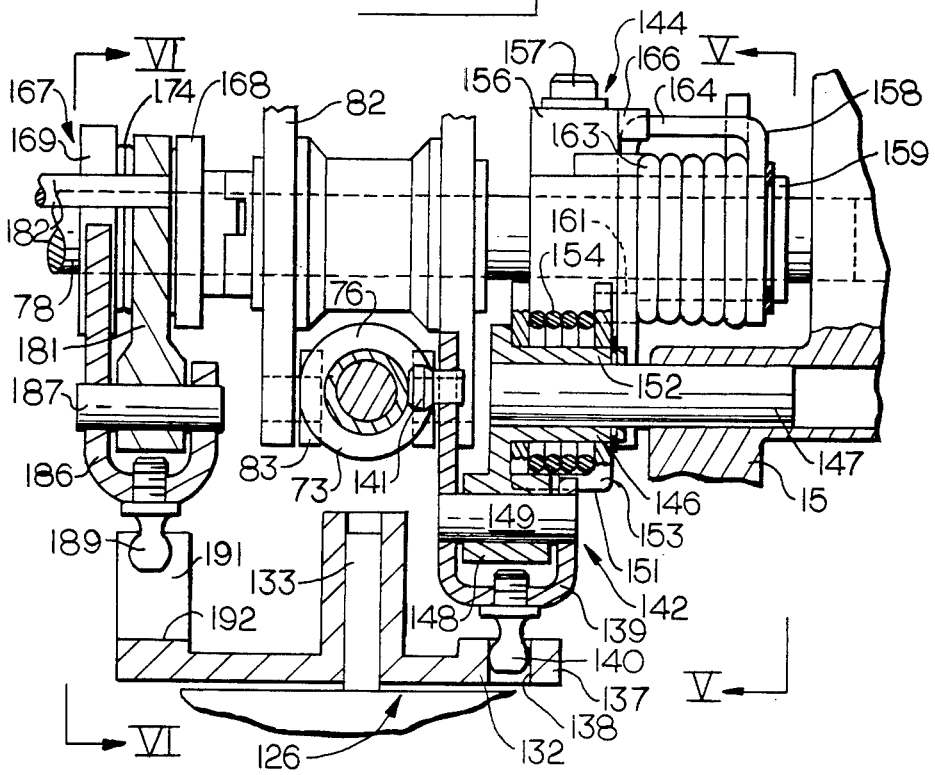
FIG. 4 is a somewhat enlarged partial sectional view taken along line IV—IV of FIG. 1.
Figure 5:
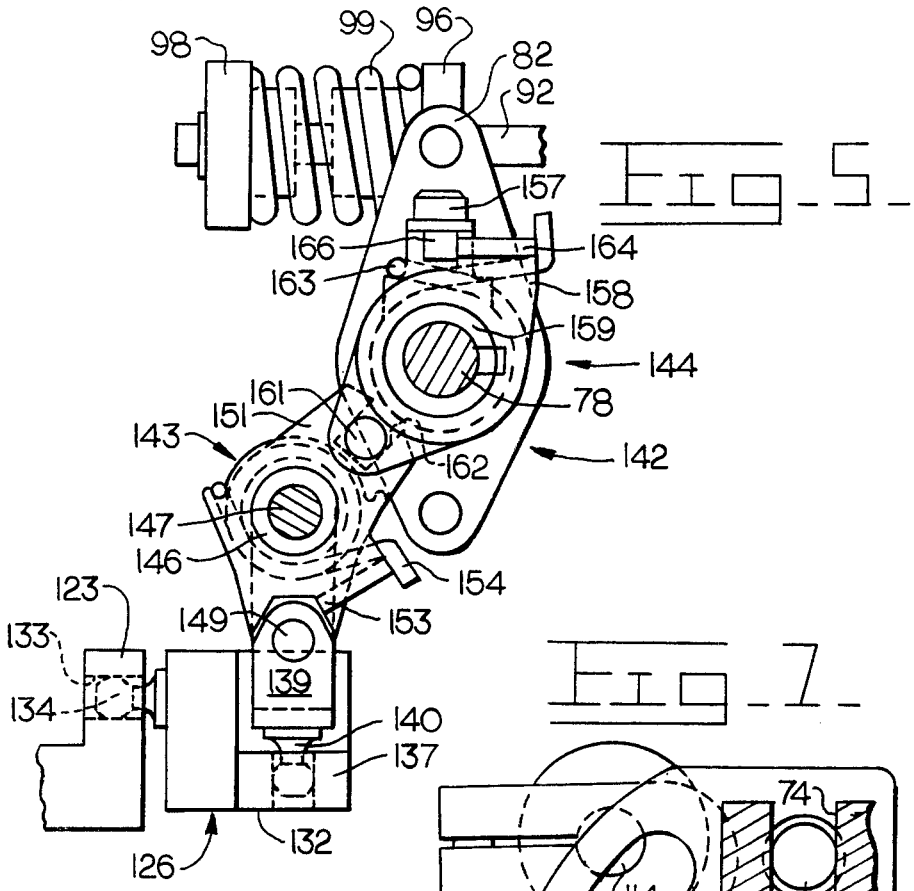
FIG. 5 is a view taken along line V—V of FIG. 4.

A linkage means 121 is also provided for translating rectilinear motion of the riser 73 into rotary motion of the metering collar 41. Referring to FIGS. 2, 4 and 5, the linkage means 121 includes a lever mechanism 122 having first and second lever arms 123,124 and a means 126 for connecting the first arm 123 to the riser 73. The lever mechanism includes a shaft 127 pivotally positioned within a bore 128 of the housing 15. The first and second lever arms 123,124 are connected to opposite ends of the shaft 127. A spherical pin 129 is connected to the second arm 124 and extends into a slot 131 formed in the metering collar 41.

The connecting means 126 includes a laterally disposed lever mechanism 132 pivoted on a pin 133 connected to the housing 15. A spherical pin 134 is connected to and extends outwardly from the lever mechanism 132 into a bore 136 in the first lever arm 123 of the lever mechanism 122. The lever mechanism 132 has a laterally extending lever arm 137 and a bore 138 defined in the lever arm 137. A floating fulcrum lever 139 is pivotally connected to the lever arm 137 by a spherical pin 140 extending into the bore 138. The lever 139 carries a pin 141 which extends into the annular groove 76 of the riser 73. A floating pivot means 142 is provided for floatingly pivotally connecting the fulcrum lever 139 to the housing 15 and for interconnecting the fulcrum lever to the control shaft 78 for manually controlling the rotary position of the metering collar 41.

As best shown in FIGS. 4 and 5, the floating pivot means 142 includes a pair of broken link mechanism 143,144. The first broken link mechanism 143 includes a support member 146 pivotally mounted on a support shaft 147 connected to the housing 15. An arm 148 of the support member 146 is pivotally connected to the fulcrum lever 139 by a pin 149. A U-shaped member 151 is pivotally mounted on a protruding boss 152 of the support member 146 and has a stop portion 153 yieldingly biased against the support member 146 by a torsion spring 154. The second broken link mechanism 144 includes a support member 156 fixedly connected to the control shaft 78 by a bolt 157. A U-shaped member 158 is pivotally mounted on a boss 159 of the support member 156 and carries a pin 161 which extends into a slot 162 formed in the U-shaped member 151. A torsion spring 163 yieldingly biases a stop portion 164 into abutment with a lug 166 formed on the support member 156.

Referring to FIGS. 4 and 6, a cam and lever mechanism 167 is provided for limiting the maximum fuel quantity delivered and for providing excess fuel for starting the engine. The cam mechanism 167 includes a cylindrical support member 168 rotatably positioned on the control shaft 78 and suitably positively connected to the riser lever 82 for unitary rotation therewith. A cam plate 169 is rotatably mounted on a reduced diameter portion 171 of the support member 168 and has a notch 172 formed in the outer face thereof. A pin 173 extends radially outwardly from the reduced diameter portion 171 of the support member 168 and into the notch 172. A torsion spring 174 yieldingly biases the cam plate 169 counterclockwise as viewed in FIG. 6 so that an edge surface 176 of the notch is biased into abutment with the pin 173. The cam plate has first and second cam sectors 177,178 formed thereon and define a shoulder 179 therebetween. A bellcrank 181 is pivotally mounted on a shaft 182 connected to the housing 15 and has first and second arms 183 and 184. An abutment lever 186 is pivotally connected to the first arm by a pivot pin 187 and has a cam follower 188 positioned for engagement with the first cam sector 177. A spherical pin 189 is connected to and extends from the abutment lever 186 into a slot 191 defined in a second arm 192 of the lever mechanism 132. An adjustable stop in the form of a bolt 193 is adjustably connected to the housing 15 and is positioned for abutment therewith by the second arm 184.

INDUSTRIAL APPLICABILITY

The operation of the fuel injection apparatus 10 will be described as though the apparatus is suitably connected to an engine so that the drive shaft 18 is driven by the engine, the inlet passageway 34 receives fuel from a transfer pump, and each of the outlet ports 33 are connected to fuel injectors which inject fuel into the combustion chambers of the engine.

In the operation of the fuel injection apparatus, the drive shaft 18 imparts a nutating or wobble type motion to the nutating disc 22 causing the plunger assembly 17 to reciprocate within the pumping chamber 16 thereby delivering one charge of fuel through the delivery passage 32 for each revolution of the drive shaft 18. The drive shaft is driven at twice the engine rpm such that four pumping strokes occur in the 720° of engine crankshaft rotation required for a complete cycle of a four cylinder, four cycle engine. The planetary gear arrangement 13 provides a four-to-one speed reduction so that the distributor rotor 36 rotates at one half the engine speed. Thus the distributor rotor makes one complete revolution for every 720° of engine crankshaft rotation. The distributor rotor rotation and plunger assembly reciprocation are arranged in a timed phased relationship so that each charge of fuel passing through the delivery passage 32 is sequentially delivered to the outlet ports 33 in a predetermined pattern. On the retraction stroke of the plunger assembly 17, one of the relief slots 39 communicate with the delivery passage for refilling the pumping chamber 16.

The lever mechanism 107 controls the rotary position of the ring gear 49 which in turn controls the timing phase relationship between the distributor rotor 36 and the drive shaft 18 and hence the timing phase relationship between the passage 37 in the rotor 36 and the delivery passage 32. This controls the start of fuel delivery from the delivery passage 32 through the passage 37 to each of the outlet ports 33 and thereby determines the beginning moment of fuel injection commonly referred to as engine timing. Rotating the ring gear 49 in a first direction advances the engine timing while rotating the ring gear in the second direction retards the engine timing.

The lever mechanism 122 controls the rotary position of the metering collar 41 which in turn controls the timing phase relationship between the passage 37 and the vent port 42 in the metering collar. Opening the passage 37 into the vent port 42 controls the terminal moment of fuel injection and thus the metered quantity of fuel delivered through the respective outlet port 33 for determining the operating speed of the engine. For example, rotating the metering collar 41 in a first direction increases the metered quantity of fuel delivered through each outlet port 33 thereby increasing engine speed while rotating the metering collar in a second direction decreases the metered quantity of fuel delivered through each outlet port thereby decreasing the engine speed.

The flyweight carrier 61 of the flyweight assembly 60 is driven by the drive shaft 18 in direct proportion to the engine speed. As the engine speed increases the flyweights 69 pivot outwardly under the influence of centrifugal force. The arms 72 of the flyweights press against the thrust bearing 68 thereby moving the riser shaft 66 and the riser 73 leftwardly as viewed in FIG. 2. The leftward movement of the riser 73 is resisted by the springs 99 and 95 through clockwise rotation of the riser lever 83 about the control shaft 78 as viewed in FIG. 2. The spring 99 is active at low engine speed and is generally referred to as a "low idle" spring. As the engine speed increases, the spring seat 96 engages the spring retainer 98 so that the centrifugal force is thereafter resisted primarily by the spring 95. The spring 95 is thus commonly referred to as a "high idle" spring. As engine speed decreases and the centrifugal force generated by the flyweights decreases, the springs 95 and 99 move the riser 73 rightwardly through counterclockwise rotation of the riser lever 82 as viewed in FIG. 2. Thus, the rectilinear postion of the riser 73 is directly related to the speed of the engine.

In the normal operating speed range of the engine between low idle and high idle, leftward movement of the riser 73 results in the ring gear 49 being rotated in the first timing advance direction while rightward movement of the riser 73 results in the ring gear being rotated in the second timing retarding direction. More specifically, movement of the riser 73 causes the cam plate 117 to pivot about the shaft 118 due to the pin 120 extending into the annular slot 74 of the riser 73. The cam follower 116 extending into the timing slot 119 rotates the lever arm 108 of the lever mechanism 107 which in turn rotates the body 110 in the bore 111. The eccentric pin 112 engaging the slot 113 in the ring gear 49 rotates the ring gear. As previously noted, rotating the ring gear changes the timing phase relationship between the distributor rotor 36 and the delivery passage 32 to change the beginning moment of fuel injection. The degree of timing change and the shape of the timing curve in relation to engine speed are dictated by the shape of the timing slot 119. Thus the timing curve can be readily changed by modifying the shape of the timing slot 119.

The engine speed is selectively controlled by manual actuation of the control shaft 78. Specifically, rotating the control shaft 78 clockwise as viewed in FIG. 5 causes the metering collar 41 to be rotated in the first fuel increasing direction or counterclockwise as viewed from the right side of FIG. 2. Conversely, rotating the control shaft counterclockwise as viewed in FIG. 5 results in the metering collar 41 being rotated in the second fuel decreasing direction.

The governing section 14 is effective to maintain the engine essentially at a preselected speed as the load on the engine changes. For example, should the load on the engine increase to an extent that the engine speed decreases, the flyweight assembly 60 moves the riser 73 rightwardly as viewed in FIG. 2. The rightward movement of the riser 73 is transmitted through the floating fulcrum lever 139, the lever mechanism 132, and the lever mechanism 122 causing the metering collar 41 to rotate in the first fuel increasing direction. Conversely, when the engine speed increases, the riser moves leftwardly resulting in the metering collar 41 being rotated in the second fuel reducing direction.

In view of the foregoing, it is readily apparent that the structure of the present invention provides an improved timing control mechanism for fuel injection apparatus in which a simple planetary gear arrangement is provided for controlling the timing phase relationship between the distributor rotor and the pumping unit and hence between the distributor rotor and the delivery port connecting the pump unit with the rotor. The position of the ring gear is directly controlled by the position of the riser with the position of the riser being commensurate with the engine speed. The simple planetary gear arrangement takes up a minimum of space and is inexpensive to manufacture.

Other aspects, objects and advantages of this invention can be obtained from a study of the drawings, the disclosure and the appended claims.

I claim:

1. A fuel injection apparatus including a pumping means for delivering charges of fuel at timed intervals, a housing having a plurality of outlet ports, a distributor rotor rotatably mounted in the housing, a delivery passage communicating the charges of fuel from the pumping means to the distributor rotor, and a speed responsive device driven by the pumping means and including an element movable in response to changes in the speed of the pumping means comprising:

means for driving the distributor rotor in timed relationship to the pumping means for synchronizing the distribution of fuel charges from the delivery passage to the outlet ports, said means including a planetary gear arrangement driven by the pumping means and drivingly connected to the distributor rotor, said planetary gear arrangement including a ring gear adapted to change the timing phase relationship between the rotor and the delivery passage; and means for mechanically connecting the ring gear to the movable element so that said ring gear is rotated in response to movement of the element.

2. The fuel injection apparatus as set forth in claim 1 wherein said element of the speed responsive device is movable in a rectilinear direction, said mechanical connecting means including linkage means for translating said rectilinear motion of said element to rotary motion of the ring gear.

3. A fuel injection apparatus including a pumping means for delivering charges of fuel at timed intervals, a housing having a plurality of outlet ports, a distributor rotor rotatably mounted in the housing, a delivery passage communicating the charges of fuel from the pumping means to the distributor rotor, and a speed responsive device driven by the pumping means and including an element movable in a rectilinear direction in response to changes in the speed of the pumping means comprising:

means for driving the distributor rotor in timed relationship to the pumping means for synchronizing the distribution of fuel charges from the delivery passage to the outlet ports, said means including a planetary gear arrangement driven by the pumping means and drivingly connected to the distributor rotor, said planetary gear arrangement including a ring gear adapted to change the timing phase relationship between the rotor and the delivery passage, said ring gear having a slot defined therein; and means for mechanically connecting the ring gear to the movable element so that said ring gear is rotated in response to movement of the element, said mechanical connecting means including linkage means for translating said rectilinear motion of said element to rotary motion of the ring gear, said linkage means including a lever mechanism having a lever arm, and means for connecting the lever arm to the element, said lever mechanism being pivotally connected to the housing and having an eccentrically disposed pin extending into the slot of the ring gear.

4. The fuel injection apparatus as set forth in claim 3 wherein said means for connecting the lever arm to the element includes an annular groove in the element, a timing cam having a timing slot defined therein and being pivotally connected to the housing, a pin connected to the timing cam and extending into the annular groove, and a cam follower connected to the lever arm of the lever mechanism and positioned within the timing slot.

5. The fuel injection apparatus as set forth in claim 4 wherein said planetary gear arrangement includes a plurality of carrier pins connected to and extending from an end of the distributor rotor, and a plurality of planet gears rotatably carried by the carrier pins and meshing with the ring gear.

6. The fuel injection apparatus as set forth in claim 5 wherein said planetary gear arrangement includes a sun gear meshing with the planet gears and being driven by said pumping means.

* * * * *